US010603804B2

(12) United States Patent
Dobbs

(10) Patent No.: US 10,603,804 B2
(45) Date of Patent: Mar. 31, 2020

(54) SHEATH WITH ATTACHMENT SYSTEM

(71) Applicant: Benchmade Knife Co., Inc., Oregon City, OR (US)

(72) Inventor: James Dobbs, Oregon City, OR (US)

(73) Assignee: Benchmade Knife Co., Inc., Oregon City, OR (US)

( * ) Notice: Subject to any disclaimer, the term of this patent is extended or adjusted under 35 U.S.C. 154(b) by 0 days.

(21) Appl. No.: 16/116,134

(22) Filed: Aug. 29, 2018

(65) Prior Publication Data

US 2019/0061190 A1 Feb. 28, 2019

Related U.S. Application Data

(60) Provisional application No. 62/551,772, filed on Aug. 29, 2017.

(51) Int. Cl.

| | |
|---|---|
| ***B26B 29/02*** | (2006.01) |
| ***A45F 5/02*** | (2006.01) |
| ***A62B 3/00*** | (2006.01) |
| ***A45F 5/00*** | (2006.01) |

(52) U.S. Cl.

CPC ..... *B26B 29/025* (2013.01); *A45F 5/00* (2013.01); *A45F 5/02* (2013.01); *A62B 3/00* (2013.01); *A45F 5/021* (2013.01); *A45F 2200/0575* (2013.01); *A45F 2200/0591* (2013.01); *A62B 3/005* (2013.01); *B26B 29/02* (2013.01)

(58) Field of Classification Search

CPC ..... B26B 29/02; B26B 29/025; A45F 5/00; A45F 5/021; A41D 13/0012

USPC ..... 224/232; 292/251.5

See application file for complete search history.

(56) References Cited

U.S. PATENT DOCUMENTS

| | | | | |
|---|---|---|---|---|
| 5,138,768 | A * | 8/1992 | Collins | B26B 3/06 224/232 |
| 5,315,761 | A * | 5/1994 | Norton | B26B 29/025 224/232 |
| 5,379,520 | A * | 1/1995 | Collins | B26B 29/025 224/232 |
| 5,572,793 | A | 11/1996 | Collins et al. | |
| D443,759 | S * | 6/2001 | Bloch | D3/220 |
| 7,200,871 | B1 | 4/2007 | Carlson | |
| D542,029 | S * | 5/2007 | Schmidt | D3/220 |
| 7,434,316 | B2 * | 10/2008 | Nenadic | B26B 3/06 30/143 |
| 7,780,048 | B2 * | 8/2010 | Howell | A41D 13/0012 224/196 |

(Continued)

FOREIGN PATENT DOCUMENTS

| | | | |
|---|---|---|---|
| CN | 105873471 A | 8/2016 | |
| DE | 202017104997 U1 * | 8/2017 | A45F 5/021 |

OTHER PUBLICATIONS

Blade Tricks, Bladetricks Modular Magazine Pouch with Trick Clip Molle Attachment; retrieved on Aug. 14, 2017 from URL: https://www.pinterest.com/pin/437764026251636938; 9 pages.

(Continued)

*Primary Examiner* — Justin M Larson

(74) *Attorney, Agent, or Firm* — Schwabe, Williamson & Wyatt, P.C.

(57) ABSTRACT

A sheath attaches to MOLLE webbing using one large hook that secures underneath the top of MOLLE webbing and two or more hooks that attach over the bottom of MOLLE webbing.

20 Claims, 10 Drawing Sheets

(56) References Cited

U.S. PATENT DOCUMENTS

| | | | | |
|---|---|---|---|---|
| 7,845,527 | B1 * | 12/2010 | McMillan | F41C 33/045 224/232 |
| D639,549 | S * | 6/2011 | Freeman | D3/220 |
| 8,297,562 | B1 * | 10/2012 | Yeates | A45F 5/02 224/191 |
| 8,523,029 | B2 * | 9/2013 | Rogers | A45F 5/02 224/182 |
| 9,486,058 | B1 * | 11/2016 | Moreau | A45F 3/00 |
| 9,541,349 | B2 | 1/2017 | Benton et al. | |
| 9,579,811 | B2 * | 2/2017 | Prince | B26B 29/025 |
| 9,723,909 | B2 * | 8/2017 | Alcantra | A41D 3/00 |
| 9,770,089 | B2 * | 9/2017 | Prince | B26B 29/025 |
| D831,953 | S * | 10/2018 | Dobbs | D3/220 |
| D845,428 | S * | 4/2019 | Robinson | D22/118 |
| 10,299,574 | B1 * | 5/2019 | Chen | A45F 5/02 |
| 10,363,675 | B2 * | 7/2019 | Robinson | B26B 3/00 |
| D856,463 | S * | 8/2019 | Robinson | D22/118 |
| 2007/0289045 | A1 | 12/2007 | Evans et al. | |
| 2012/0175391 | A1 * | 7/2012 | Rogers | A45F 5/02 224/182 |
| 2013/0047386 | A1 | 2/2013 | Barfoot et al. | |
| 2013/0126566 | A1 | 5/2013 | Seuk et al. | |
| 2014/0325803 | A1 * | 11/2014 | Iannello | F16M 11/041 24/460 |
| 2014/0338197 | A1 | 11/2014 | Frazer et al. | |
| 2015/0190938 | A1 | 7/2015 | Kommer | |
| 2015/0351523 | A1 * | 12/2015 | West | A45F 5/02 224/269 |
| 2015/0377585 | A1 | 12/2015 | Fowler | |
| 2016/0318200 | A1 * | 11/2016 | Wright | B26B 29/025 |
| 2016/0360870 | A1 * | 12/2016 | Langenwalter | B26B 29/025 |
| 2016/0367021 | A1 * | 12/2016 | Moreau | A45F 3/00 |
| 2019/0009420 | A1 * | 1/2019 | Robinson | B26B 3/00 |
| 2019/0061190 | A1 * | 2/2019 | Dobbs | B26B 29/025 |

OTHER PUBLICATIONS

Gear Aid, Tactical Knife—The Titanium-Coated Knife by McNett Tactical Works; retrieved on Aug. 14, 2017 from URL: https://www.gearaid.com/products/tactical-knife-ti?variant=28044148561; 3 pages.

Gear to Fit, Simple Sheath for an ESEE 3 Knife; retrieved on Aug. 14, 2017 from URL: https://www.pinterest.com/pin/446630488022751242; 8 pages.

* cited by examiner

SHEATH WITH ATTACHMENT SYSTEM

CROSS-REFERENCE TO RELATED APPLICATION

This application claims the priority benefit of the earlier filing date of U.S. Provisional Patent Application No. 62/551,772, filed Aug. 29, 2017, which is hereby incorporated herein by reference in its entirety.

TECHNICAL FIELD

The present disclosure relates to a sheath and a system for attaching the sheath to MOLLE webbing.

BACKGROUND

Modular Lightweight Load-carrying Equipment (MOLLE) webbing is used in the current generation of load-bearing equipment and backpacks used by a number of NATO armed forces, especially the British Army and the United States Army. The system's modularity is derived from the use of rows of heavy-duty nylon stitched onto a base fabric, such as a tactical vest, to allow for the attachment of various MOLLE-compatible pouches and accessories. This method of attachment has become a de facto standard for modular tactical gear. A standard grid consists of horizontal rows of 1 inch (2.5 cm) webbing, spaced 1 inch apart, and reattached to the backing at 1.5 inches (3.8 cm) intervals. MOLLE is used to describe generically all load bearing systems and subsystems that utilize such woven webbing for modular pouch attachment.

BRIEF DESCRIPTION OF THE DRAWINGS

Embodiments will be readily understood by the following detailed description in conjunction with the accompanying drawings and the appended claims. Embodiments are illustrated by way of example and not by way of limitation in the figures of the accompanying drawings.

DETAILED DESCRIPTION OF DISCLOSED EMBODIMENTS

Figure 1:
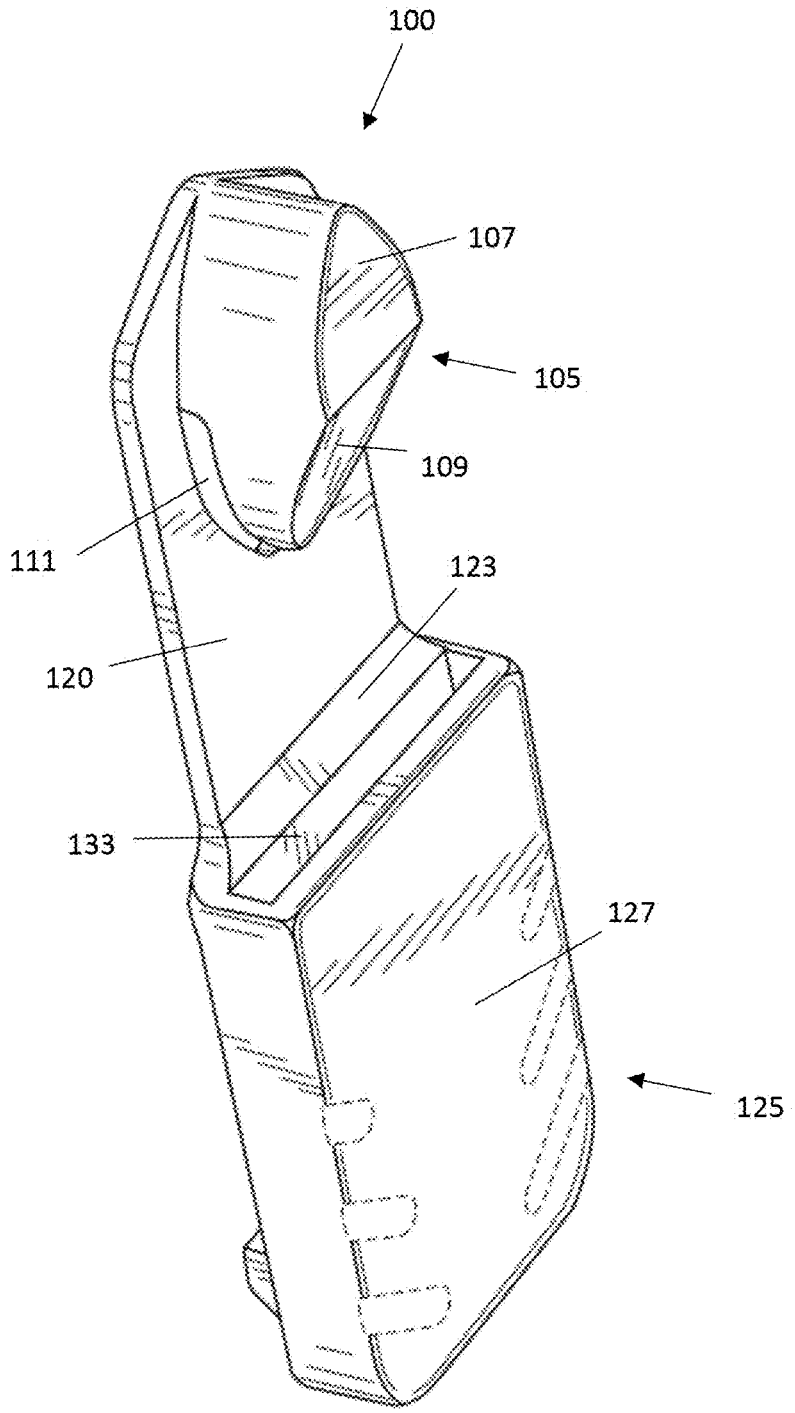
FIG. 1 is perspective view of a sheath, in accordance with various embodiments.

In the following detailed description, reference is made to the accompanying drawings, which form a part hereof, and in which are shown by way of illustration embodiments that may be practiced. It is to be understood that other embodiments may be utilized and structural or logical changes may be made without departing from the scope. Therefore, the following detailed description is not to be taken in a limiting sense, and the scope of embodiments is defined by the appended claims and their equivalents.

Various operations may be described as multiple discrete operations in turn, in a manner that may be helpful in understanding embodiments; however, the order of description should not be construed to imply that these operations are order dependent.

The description may use perspective-based descriptions such as up/down, back/front, and top/bottom. Such descriptions are merely used to facilitate the discussion and are not intended to restrict the application of disclosed embodiments.

The terms "coupled" and "connected," along with their derivatives, may be used. It should be understood that these terms are not intended as synonyms for each other. Rather, in particular embodiments, "connected" may be used to indicate that two or more elements are in direct physical contact with each other. "Coupled" may mean that two or more elements are in direct physical contact. However, "coupled" may also mean that two or more elements are not in direct contact with each other, but yet still cooperate or interact with each other.

For the purposes of the description, a phrase in the form "A/B" or in the form "A and/or B" means (A), (B), or (A and B). For the purposes of the description, a phrase in the form "at least one of A, B, and C" means (A), (B), (C), (A and B), (A and C), (B and C), or (A, B and C). For the purposes of the description, a phrase in the form "(A)B" means (B) or (AB) that is, A is an optional element.

The description may use the terms "embodiment" or "embodiments," which may each refer to one or more of the same or different embodiments. Furthermore, the terms "comprising," "including," "having," and the like, as used with respect to embodiments, are synonymous, and are generally intended as "open" terms (e.g., the term "including" should be interpreted as "including but not limited to," the term "having" should be interpreted as "having at least," the term "includes" should be interpreted as "includes but is not limited to," etc.).

With respect to the use of any plural and/or singular terms herein, those having skill in the art can translate from the plural to the singular and/or from the singular to the plural as is appropriate to the context and/or application. The various singular/plural permutations may be expressly set forth herein for sake of clarity.

Disclosed herein is a sheath that has been designed to attach to alternating rows of MOLLE webbing. The disclosed sheath provides a more secure, accessible and low profile single piece attachment system for certain cutters, such as a rescue hook (for example the 7 Hook sold by BENCHMADE®) to MOLLE. The BENCHMADE® 7 Hook was designed for a variety of emergency utility situations. The larger handle opening is designed to work well with gloved hands. The rounded end of the hook provides safety from contact with the skin while the edge on the blade steel slices through seatbelts, netting and clothing with ease. The stainless steel handle is covered in a black vinyl coating that adds durability and grip.

Disclosed herein, is a single piece sheath, such as a rescue hook sheath, that attaches to MOLLE webbing using one large hook that secures underneath and slides over the top of MOLLE webbing and two or more hooks that attach over and slide under the bottom of MOLLE webbing. In certain embodiments the one large hook projects downward while the two or more hooks that attach over and slide under the bottom of MOLLE webbing project upward, for example the one large hook and the lower hooks point in a direction toward each other, such that the MOLLE webbing may be "locked" or constrained between these hooks. The cutter is secured in the sheath cavity and by a detent feature on the sheath. The cutter can be inserted either direction along the detent surface. While particular detail is given to a rescue hook sheath this disclosure contemplates use with other cutters and their attachment to MOLLE webbing.

In embodiments, the detent feature includes an upper portion and a lower portion. Disposed between the lower portion and the sheath extension is a slot that is configured to slide over a piece of MOLLE webbing and at least partially retain the sheath to the MOLLE webbing. In embodiments, the sheath portion includes a front and a back, which are disposed about a sheath cavity. The sheath cavity is configured to allow a blade, such as the blade of the rescue hook, to slide in. In conjunction with the detent, the sheath cavity effectively and safely retains a cutter in place in a retained position. In certain embodiments, the sheath extension includes a sloped portion that offsets the plane of the internal surface of the back of the sheath portion relative to the sheath extension. This allows the cutter to more easily slide into the sheath cavity of the sheath portion and lay flat in this configuration.

In certain embodiments, the detent is configured to contact a handle, such as the handle of a rescue hook, such that an exterior surface of the upper portion of the detent rests against a surface of the handle. In embodiments, this interaction creates a friction fit and helps to retain the rescue hook or other cutter in the sheath cavity. In embodiments, the upper portion of the detent is curved and matches, at least approximately, a curved surface of the handle, such as the handle of a rescue hook. In embodiments, the upper portion of the detent is symmetrical about a central axis running from the top end to the bottom end of the sheath. In embodiments, the symmetry allows the rescue hook or other cutter to be positioned in either direction. In embodiments, the lower portion of the detent is curved and matches, at least approximately, a surface of the handle, such as the handle of a rescue hook. In embodiments, the lower portion of the detent is symmetrical about a central axis running from the top end to the bottom end of the sheath. In embodiments, the symmetry allows the rescue hook to be positioned in either direction. In certain embodiments, the lower portion of the detent is slopped down from the upper portion of the detent, for example toward the sheath extension. In embodiments, the slope of the lower potion of the detent allows for a handle of a blade to more easily slide over the detent, for example, to facilitate moving a rescue hook or other cutter in and out of the sheath.

In embodiments, the back side of the sheath includes two or more, such as between 2 and 10 lower hooks that are configured to slide over and behind MOLLE webbing and work with the slot and the lower portion of the detent to secure the sheath to the MOLLE webbing, such as to alternating rows of MOLLE webbing. By way of example, as the lower portion of the detent fits over a strap of MOLLE webbing, which is secured to a backing material, the MOLLE webbing slides within the slot until a top edge of the MOLLE webbing is in contact with the top of the slot. This secures the MOLLE webbing between the sheath extension and the bottom portion of the detent. The lower hooks then slide over the MOLLE webbing and are retained behind the MOLLE webbing, such as the next row of MOLLE webbing, so that the sheath is constrained by the alternating straps of MOLLE webbing. It is contemplated that the disclosed sheath can be attached in any orientation to MOLLE webbing. The designation of up and down directions in not limiting, but meant to only facilitate the discussion.

Systems are disclosed that include a sheath and a rescue hook. In certain embodiments, a rescue hook system includes a rescue hook having a blade and a handle, and a sheath configured to retain the rescue hook and attach to MOLLE webbing. In certain embodiments, the sheath includes: a sheath portion configured to at least partially retain the rescue hook blade; a detent element comprising an upper portion and an lower portion, and configured to couple the sheath to the MOLLE webbing and at least partially retain the rescue hook handle; two or more lower hooks that are configured to slide over MOLLE webbing to at least partially secure the sheath to the MOLLE webbing; and a sheath extension extending from the sheath portion to the detent element, thereby coupling the detent element to the sheath portion.

Figure 2:
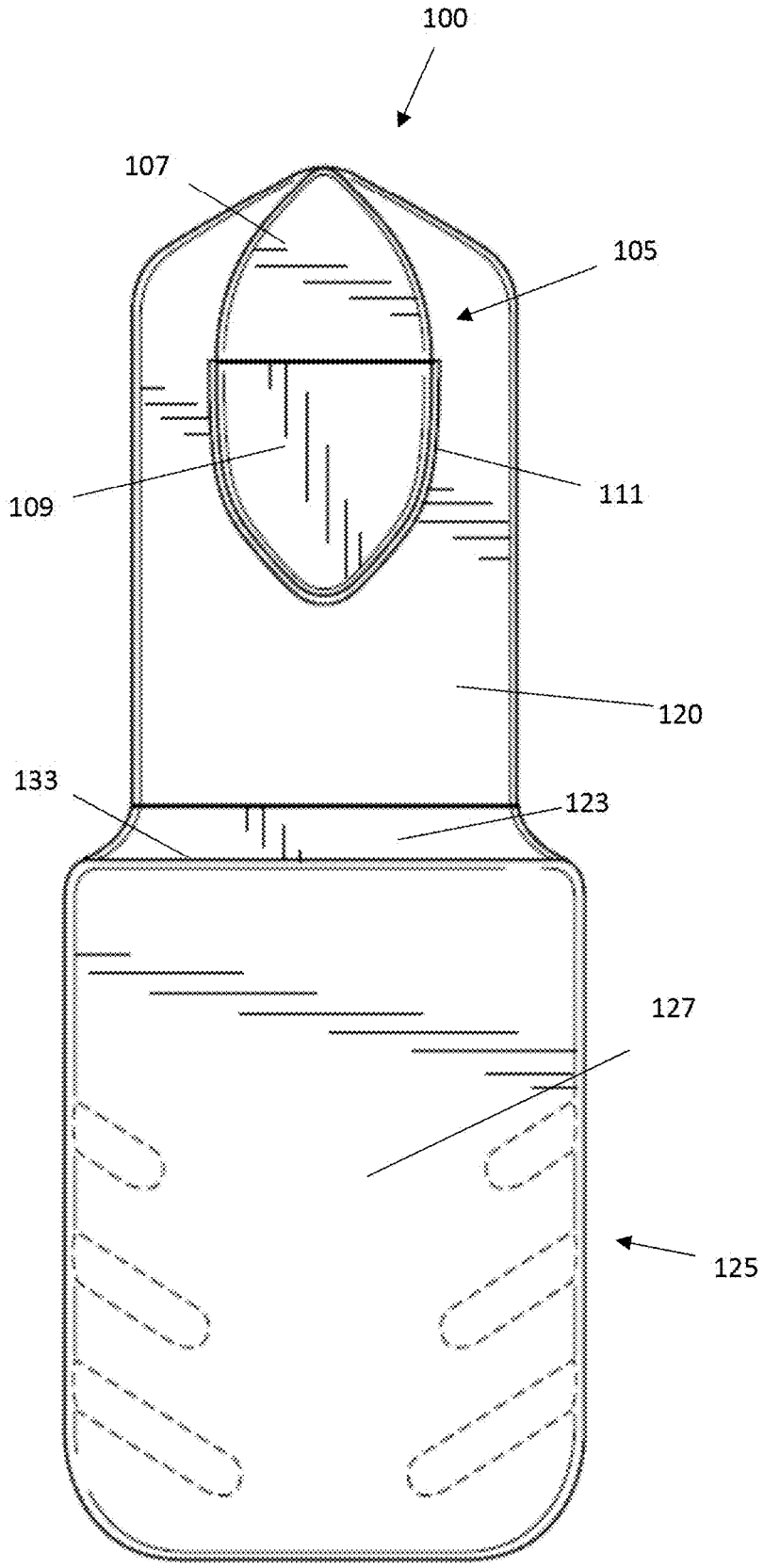
FIG. 2 is a front view of the sheath shown in FIG. 1, in accordance with various embodiments.

FIGS. 1-11 depict embodiments of a sheath, such as a rescue hook sheath, disclosed herein. As shown in FIGS. 1 and 2 the sheath 100 includes, on the front, a detent 105, a sheath portion 125, and a sheath extension 120 that connects the detent 105 to the sheath portion 125. As shown in these views, the detent 105 includes an upper portion 107, that as shown is generally planar with the sheath extension 120, and a lower portion 109, that as shown slopes toward the sheath extension 120. The slope of the lower portion 109 allows a blade, such as a rescue hook, to slide more easily in and out of the sheath. Disposed between the lower portion 109 and the sheath extension 120 is a slot 111 that is configured to slide over a piece of MOLLE webbing (not shown in these viewa), which acts in concert with other features of the sheath 100 to retain the sheath 100 to the MOLLE webbing. The sheath portion 125 includes a front 127 and a back (not easily visible in these views). Disposed between the front 127 and the back is a sheath cavity 133 that is configured to allow a blade portion of an implement, such as a rescue hook, to slide in. In conjunction with the detent 105, the sheath portion 125 effectively and safely retains a bladed implement in place in a retained position. Also shown is a sloped portion 123 of the sheath portion 125, which acts to offset the plane of an internal surface of the back side of the sheath portion 125 relative to the sheath extension 120 and allows the bladed implement to more easily slide into the sheath cavity 133 of the sheath portion 125 and lay flat.

Figure 3:
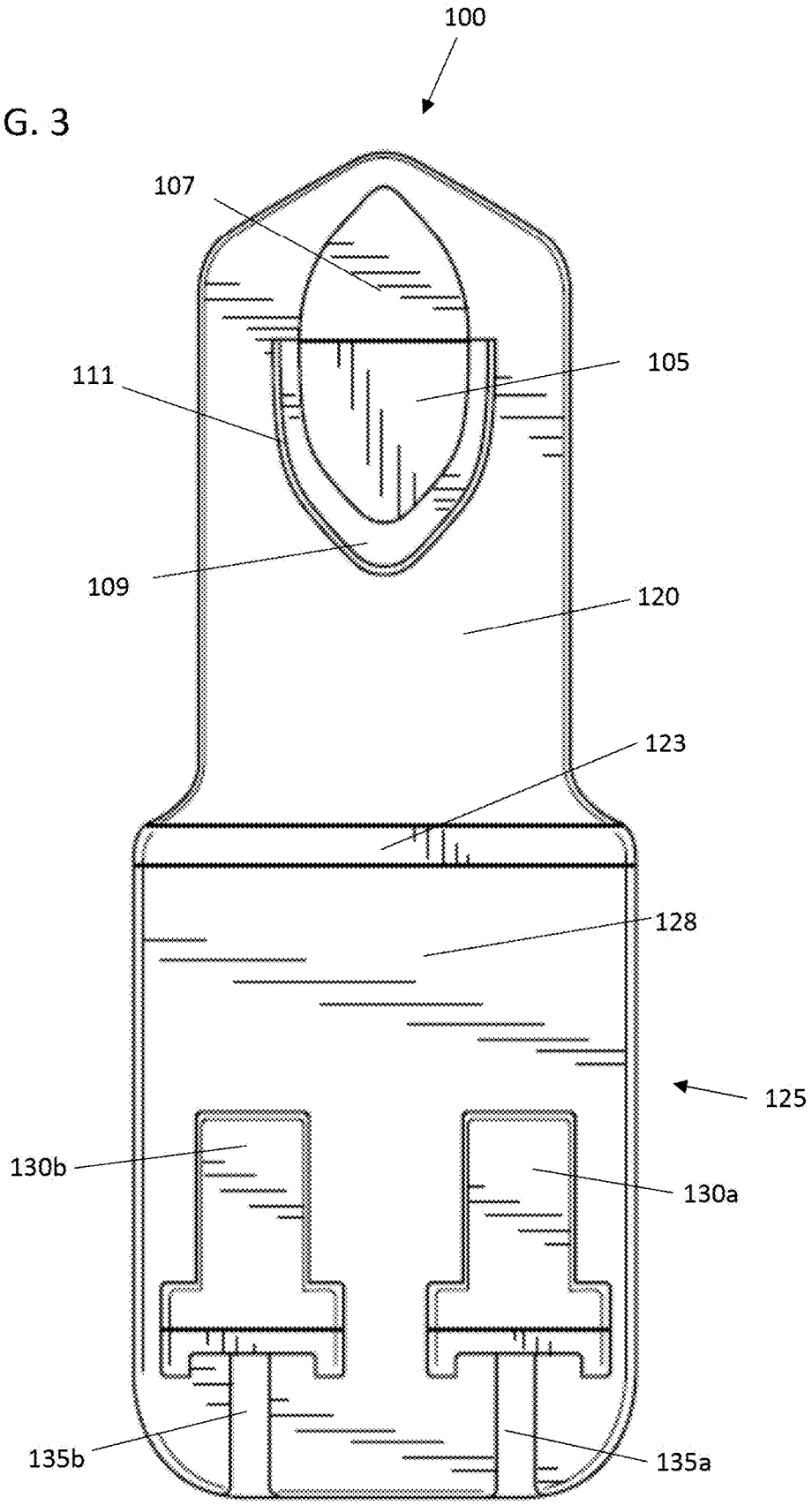
FIG. 3 is a back view of the sheath shown in FIG. 1, in accordance with various embodiments.

FIG. 3 is a back view of sheath 100. In addition to those features of the sheath 100 shown in FIGS. 1 and 2, FIG. 3 shows some additional details which are not readily viewable from the front. In particular, FIG. 3 shows the back 128 of the sheath portion 125 and its connection via the sloped portion 123 to the sheath extension 120. Also better seen in this view is the slot 111 disposed between the sheath extension 120 and the lower portion 109 of the detent 105. In addition to the features mentioned above, FIG. 3 shows lower hooks 130*a* and 130*b* that are configured to slide over MOLLE webbing and work with the slot 111 and the lower portion 109 of the detent to secure the sheath 100 to alternating rows of MOLLE webbing. Also shown in this view are relief slots 135*a* and 135*b*.

Figure 4:
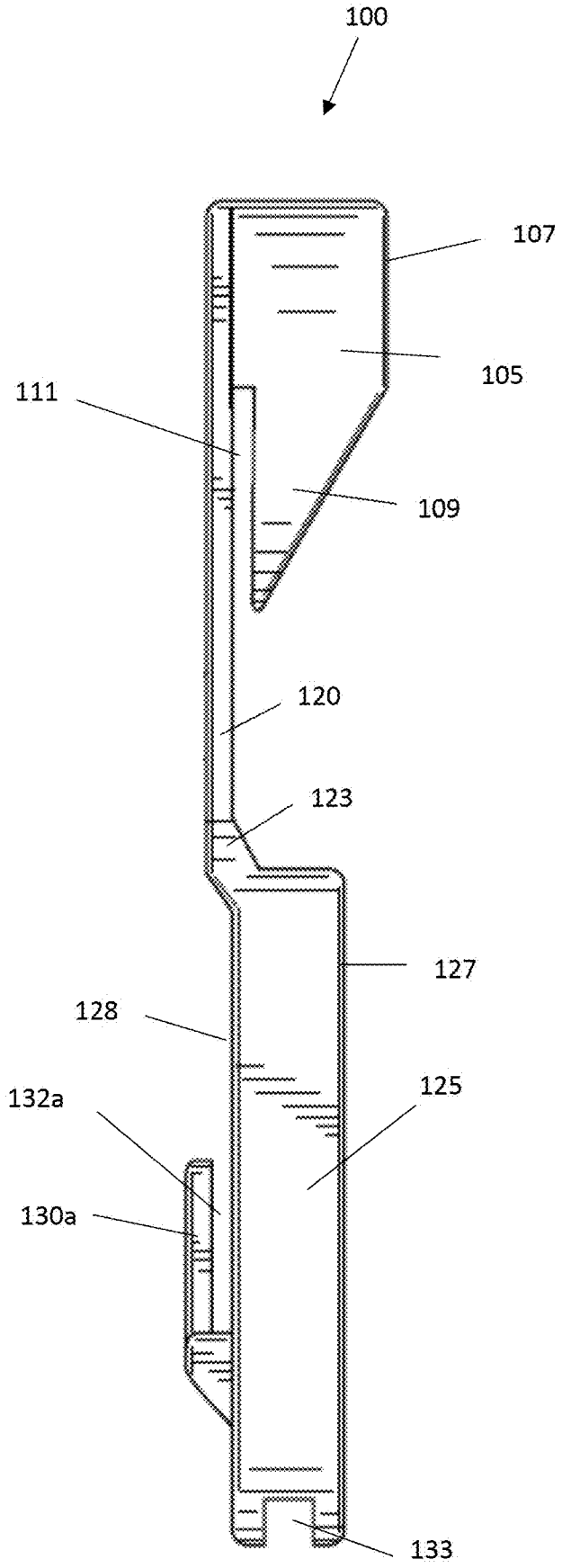
FIG. 4 is a left side view of the sheath shown in FIG. 1, in accordance with various embodiments.
Figure 5:
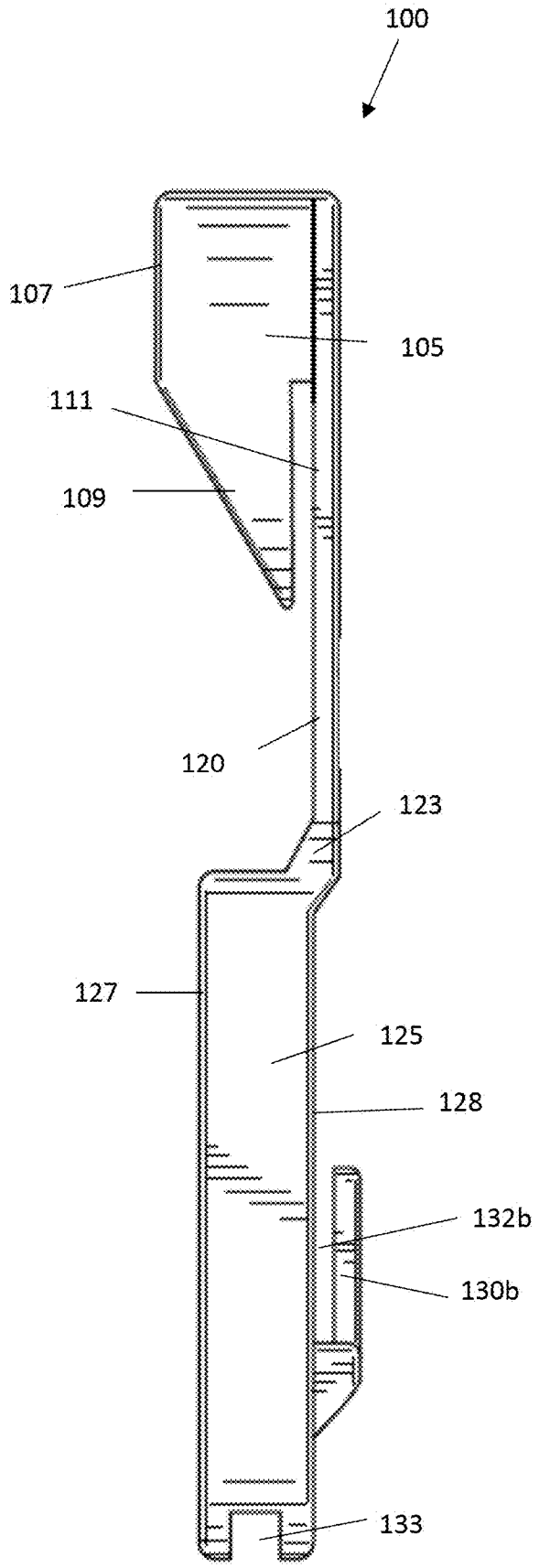
FIG. 5 is a right side view of the sheath shown in FIG. 1, in accordance with various embodiments.

FIGS. 4 and 5 are left and right side views, respectively, of the sheath 100. In addition to the features discussed above with respect to FIGS. 1-3, the lower hooks 130*a* and 130*b* are best seen in these views. The lower hooks 130*a* and 130*b* are separated from the back 128 of the sheath portion 125 thus providing slots 132*a* and 132*b* that allow the lower hooks 130*a* and 130*b* to couple to MOLLE webbing, for example by sliding MOLLE webbing into slots 132*a* and 132*b*.

Figure 6:
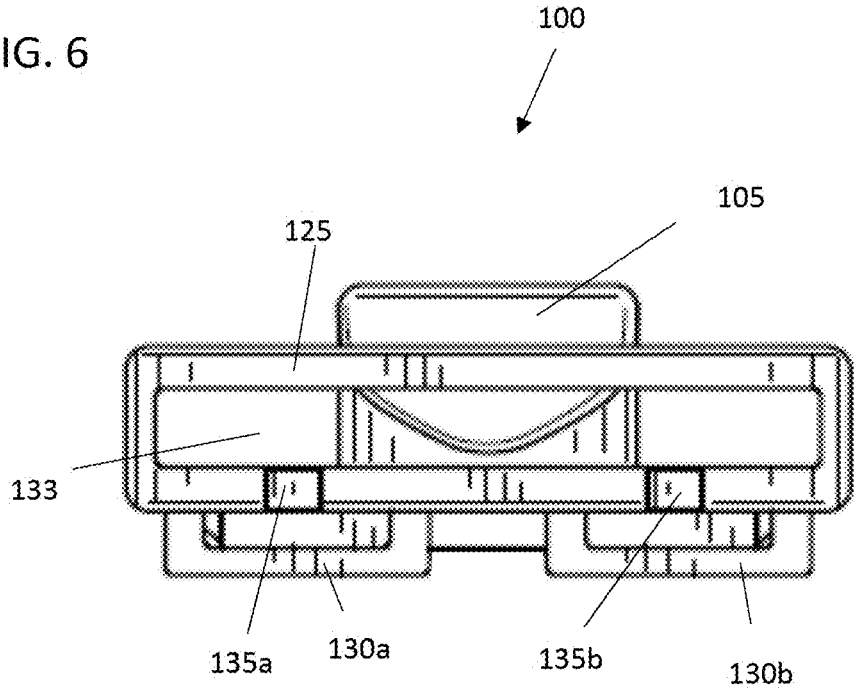
FIG. 6 is a bottom view of the sheath shown in FIG. 1, in accordance with various embodiments.

FIG. 6 is a bottom view of sheath 100, further showing the features discussed above.

Figure 7:
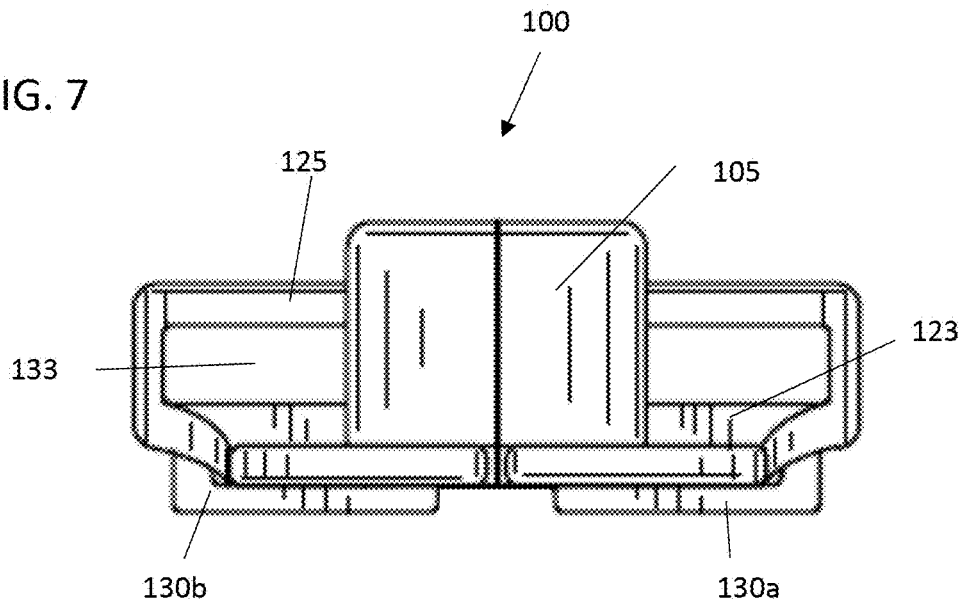
FIG. 7 is a top view of the sheath shown in FIG. 1, in accordance with various embodiments.

FIG. 7 is a top view of sheath 100, further showing the features discussed above.

Figure 8:
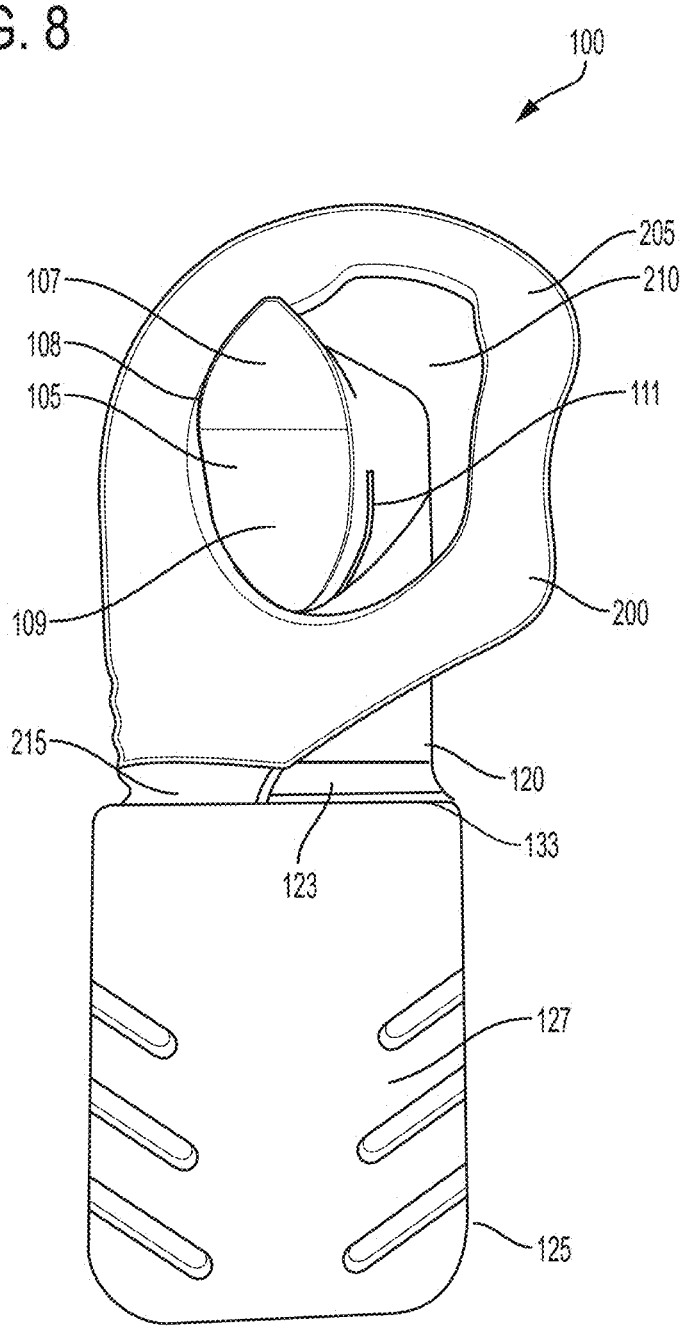
FIG. 8 is a front view of a sheath shown with a rescue hook inserted therein, in accordance with various embodiments.

FIG. 8 is a front view of a sheath 100 shown with a rescue hook 200 inserted therein, in accordance with various embodiments. Also shown in FIG. 8 are various elements of the rescue hook 200 and their interaction with the detent 105 that help retain the rescue hook 200 in the sheath 100. The rescue hook 200 includes a handle portion 205 and the blade portion 215. The handle portion 205 includes an internal hole 210 that fits over the detent 105 of the sheath 100. The detent 105 of the sheath 100 is configured to nestle within the hole 210 of the rescue hook 200 such that an exterior surface 108 of the upper portion 107 of the detent 105 rests against the interior surface of the hole 210. This interaction creates a friction fit and helps to retain the rescue hook 200 in the sheath cavity 133 of the sheath portion 125. The upper portion 107 of the detent 105 is curved and matches, at least approximately, the internal curvature of the hole 210. In addition, the upper portion 107 of the detent 105 is symmetrical about a central axis running from the top to the bottom of the sheath 100. The symmetry allows the rescue hook 200 to be positioned in either direction. In addition to the upper portion 107, the lower portion 109 of the detent 105 is curved and matches, at least approximately, the internal curvature of the hole 210. In addition, lower portion 109 of the detent 105 is symmetrical about a central axis running from the top to the bottom of the sheath 100. The symmetry allows the rescue hook 200 to be positioned either direction.

Figure 9:
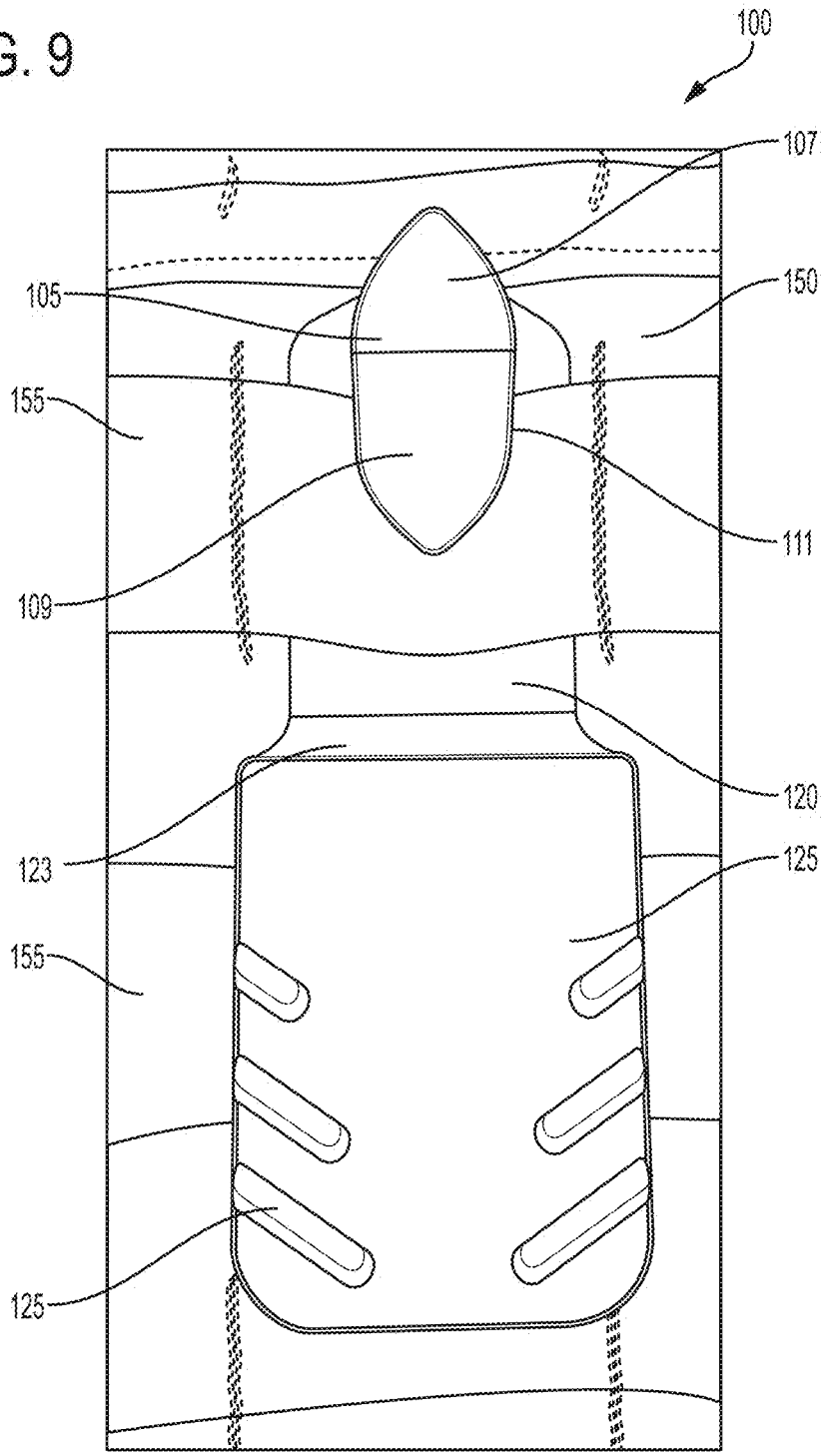
FIG. 9 is a front view of a sheath shown attached to MOLLE webbing, in accordance with various embodiments.
Figure 10:
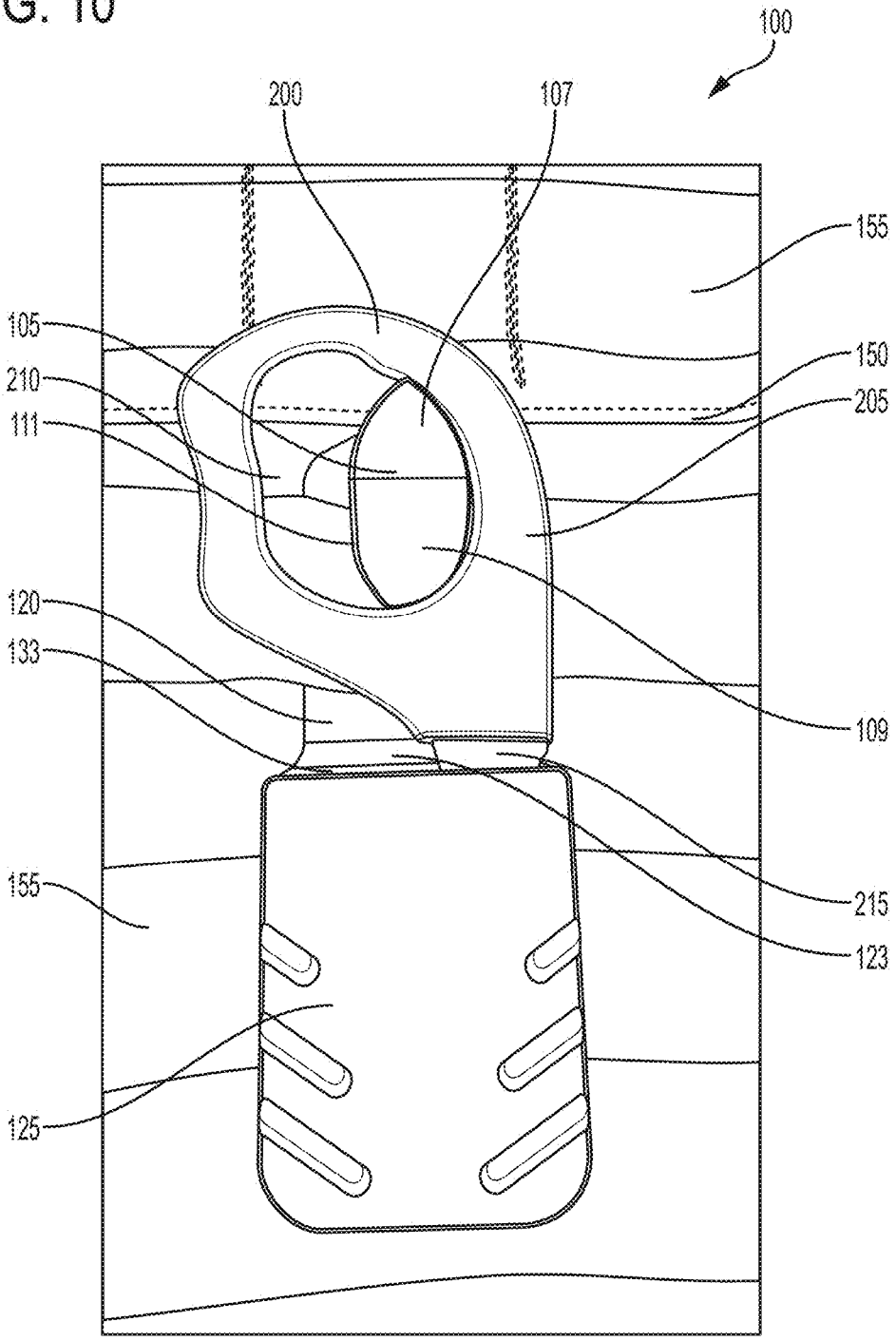
FIG. 10 is a front view of a sheath shown attached to MOLLE webbing with a rescue hook inserted therein, in accordance with various embodiments.
Figure 11:
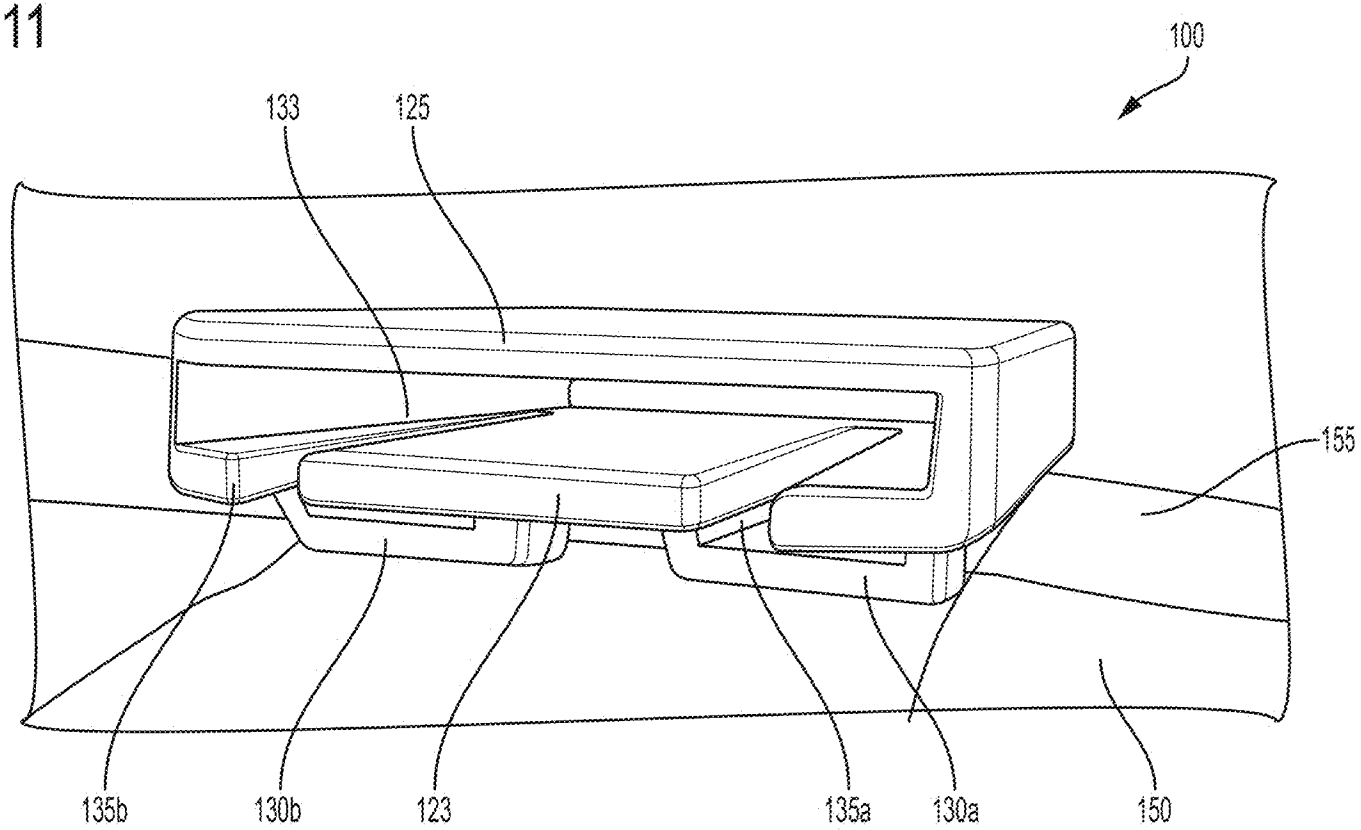
FIG. 11 is a bottom view of a sheath shown attached to MOLLE webbing, in accordance with various embodiments.

FIGS. 9-11 show the sheath 100 coupled to the MOLLE webbing 155. FIG. 9 is a front view of sheath 100 shown attached to MOLLE webbing 155, in accordance with various embodiments. FIG. 10 is a front view of sheath 100 shown attached to MOLLE webbing 155 with a rescue hook 200 inserted therein, in accordance with various embodiments. As shown in FIGS. 9 and 10, the lower portion 109 of the detent 105 fits over a strap of MOLLE webbing 155 which is secured to a backing material 150. The MOLLE webbing 155 slides within the slot 111 until a top edge of the MOLLE webbing 155 is in contact with the top of the slot 111. This secures the MOLLE webbing 155 between the sheath extension 120 and the bottom portion 109 of the detent 105. While not readily visible in these views, the lower hooks 130*a* and 130*b* slide over the next row of MOLLE webbing 155 so that the sheath 100 is constrained by the alternating straps of MOLLE webbing 155.

FIG. 11 is a bottom view of sheath 100 shown attached to MOLLE webbing 155, in accordance with various embodiments. FIG. 11 best shows the lower hooks 130*a* and 130*b* coupled to MOLLE webbing 115. Also shown in this view are relief slots 135*a* and 135*b*.

Although certain embodiments have been illustrated and described herein, it will be appreciated by those of ordinary skill in the art that a wide variety of alternate and/or equivalent embodiments or implementations calculated to achieve the same purposes may be substituted for the embodiments shown and described without departing from the scope. Those with skill in the art will readily appreciate that embodiments may be implemented in a very wide variety of ways. This application is intended to cover any adaptations or variations of the embodiments discussed herein. Therefore, it is manifestly intended that embodiments be limited only by the claims and the equivalents thereof.

The invention claimed is:

1. A sheath for attachment to MOLLE webbing, comprising:

a sheath portion configured to at least partially retain a cutter having a blade and a handle;

a detent element comprising an upper portion and a lower portion, and configured to couple the sheath to the MOLLE webbing and at least partially retain the handle;

two or more lower hooks that are configured to slide over MOLLE webbing to at least partially secure the sheath to the MOLLE webbing; and a sheath extension extending from the sheath portion to the detent element, thereby coupling the detent element to the sheath portion, and wherein the sheath extension resides under the MOLLE webbing when the sheath is coupled to the MOLLE webbing.

2. The sheath of claim 1, wherein the sheath further comprises a MOLLE slot disposed between the upper portion and the sheath extension configured to slide over the MOLLE webbing to couple the sheath to the MOLLE webbing.

3. The sheath of claim 1, wherein the sheath portion includes a front and a back disposed about a sheath cavity, and wherein the sheath cavity is configured to allow the blade of the cutter to slide in.

4. The sheath of claim 3, wherein the sheath extension includes a sloped portion that offsets a plane of an internal surface of the back of the sheath portion relative to the sheath extension.

5. The sheath of claim 1, wherein the detent is configured to contact the handle, such that an exterior surface of the upper portion of the detent rests against a surface of the handle when the handle is in the retained position to retain the handle.

6. The sheath of claim 1, wherein the upper portion of the detent is curved and matches, at least approximately, a curved surface of the handle.

7. The sheath of claim 1, wherein the upper portion of the detent is symmetrical about a central axis running from a top end to a bottom end of the sheath.

8. The sheath of claim 1, wherein the lower portion of the detent is curved and matches, at least approximately a surface of the handle.

9. The sheath of claim 1, wherein the lower portion of the detent is symmetrical about a central axis running from a top end to a bottom end of the sheath.

10. The sheath of claim 1, wherein the lower hooks are coupled to the back of the sheath.

11. A rescue hook system, comprising:

a rescue hook having a blade and a handle; and a sheath configured to retain the rescue hook and attach to MOLLE webbing, the sheath comprising:

a sheath portion configured to at least partially retain the rescue hook blade;

a detent element comprising an upper portion and a lower portion, and configured to couple the sheath to the MOLLE webbing and at least partially retain the rescue hook handle;

two or more lower hooks that are configured to slide over MOLLE webbing to at least partially secure the sheath to the MOLLE webbing; and a sheath extension extending from the sheath portion to the detent element, thereby coupling the detent element to the sheath portion, and wherein the sheath extension resides under the MOLLE webbing when the sheath is coupled to the MOLLE webbing.

12. The sheath of claim 11, wherein the sheath further comprises a MOLLE slot disposed between the upper portion and the sheath extension configured to slide over the MOLLE webbing to couple the sheath to the MOLLE webbing.

13. The sheath of claim 11, wherein the sheath portion includes a front and a back disposed about a sheath cavity, and wherein the sheath cavity is configured to allow the blade to slide in.

14. The sheath of claim 13, wherein the sheath extension includes a sloped portion that offsets a plane of an internal surface of the back of the sheath portion relative to the sheath extension.

15. The sheath of claim 11, wherein the detent is configured to contact the handle, such that an exterior surface of the upper portion of the detent rests against a surface of the handle when the handle is in the retained position to retain the handle.

16. The sheath of claim 11, wherein the upper portion of the detent is curved and matches, at least approximately, a curved surface of the handle.

17. The sheath of claim 11, wherein the upper portion of the detent is symmetrical about a central axis running from a top end to a bottom end of the sheath.

18. The sheath of claim 11, wherein the lower portion of the detent is curved and matches, at least approximately a surface of the handle.

19. The sheath of claim 11, wherein the lower portion of the detent is symmetrical about a central axis running from a top end to a bottom end of the sheath.

20. The sheath of claim 11, wherein the lower hooks are coupled to the back of the sheath.

* * * * *